US005447471A

United States Patent [19]

McDermott

[11] Patent Number: 5,447,471

[45] Date of Patent: Sep. 5, 1995

[54] AIR FLOW CONTROLLER

[75] Inventor: Robert J. McDermott, Bangor, Northern Ireland

[73] Assignee: Airrite Building Services Limited, Bangor, Ireland

[21] Appl. No.: 232,007

[22] PCT Filed: Oct. 23, 1992

[86] PCT No.: PCT/GB92/01955

§ 371 Date: Jun. 20, 1994

§ 102(e) Date: Jun. 20, 1994

[87] PCT Pub. No.: WO93/08430

PCT Pub. Date: Apr. 29, 1993

[30] Foreign Application Priority Data

Oct. 24, 1991 [GB] United Kingdom ..... 9122640

[51] Int. Cl.[6] ..... F24F 13/072

[52] U.S. Cl. ..... 454/304; 454/258; 454/326

[58] Field of Search ..... 454/258, 301, 303, 304, 454/305, 326, 336

[56] References Cited

U.S. PATENT DOCUMENTS

| | | | |
|---|---|---|---|
| 3,308,744 | 3/1967 | Schach | 454/326 X |
| 3,327,608 | 6/1967 | Newell et al. | 454/304 |
| 3,771,559 | 11/1973 | Alley | 454/336 X |
| 3,811,369 | 5/1974 | Ruegg | 454/304 |
| 3,848,799 | 11/1974 | Day | 454/304 X |
| 4,316,407 | 2/1982 | Lambert . | |
| 5,088,388 | 2/1992 | Schaefer | 454/304 |

FOREIGN PATENT DOCUMENTS

| | | | |
|---|---|---|---|
| 2551078 | 5/1977 | Germany | 454/304 |
| 254345 | 10/1988 | Japan | 454/304 |
| 2195758 | 4/1988 | United Kingdom | 454/303 |

*Primary Examiner*—Harold Joyce

*Attorney, Agent, or Firm*—Edwin E. Greigg; Ronald E. Greigg

[57] ABSTRACT

An air flow controller has an adjustable air flow passageway and comprises a surface-mounted distribution frame housing one or more elongate passages. Each passage has an inlet, a flow channel and an outlet. The inlet has two opposed guide flaps to control the flow of air passing into the flow channel. Two opposed wall members define the width of the channel, the wall members being adapted to be position-adjusted on control movement of the guide flaps with the outer ends of the wall members defining the outlet.

15 Claims, 3 Drawing Sheets

FIG. 4.
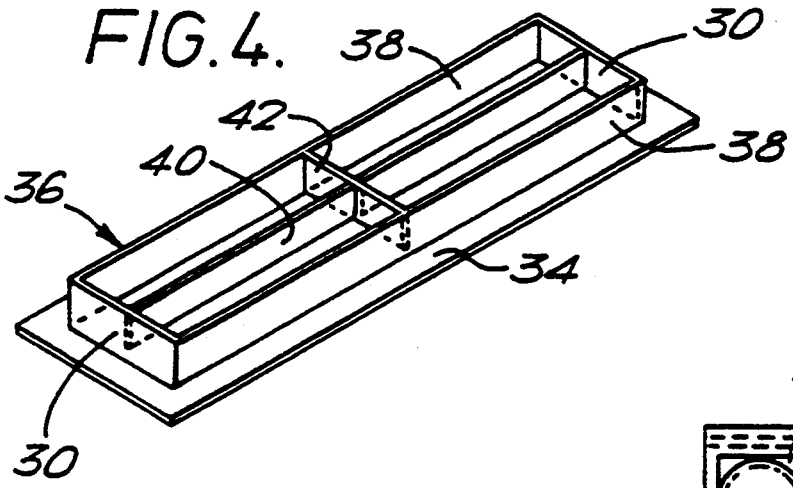
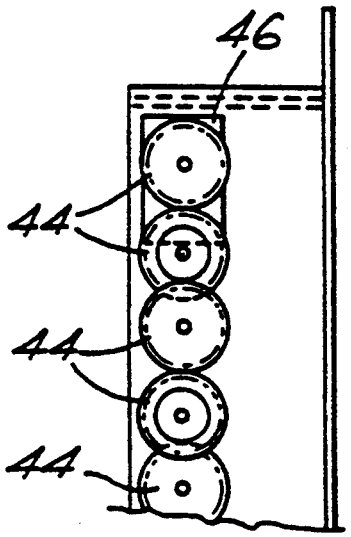
FIG. 5.
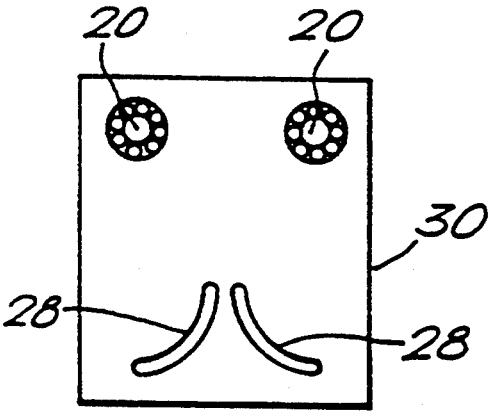
FIG. 6.
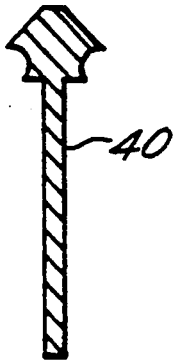
FIG. 7.

AIR FLOW CONTROLLER

This invention relates to an air flow controller, for use in air flow situations including inter alia forced air central heating, to control air passing through an air diffuser opening.

In the heating, ventillation and air conditioning sector of the building services industry, there is a requirement for an air flow controller having an adjustable air flow passageway.

Accordingly, the present invention is an air flow controller having an adjustable air flow capacity comprising a surface-mounted distribution frame housing one or more elongate passages, each passage having an inlet, a flow channel and an outlet, the inlet having two opposed guide means to control the flow of air passing into the flow channel, two opposed wall members defining the width of the channel, the wall members being adapted to be position-adjusted on control movement of the guide means with the outer ends of the wall members defining the outlet.

Preferably, the two opposed guide means for the or each passage are two elongate devices, each having a shaft, the pair of shafts each mounting a similar component having a planar control side, the shafts being counter-rotatable together to vary or close the opening therebetween. A seal is preferably provided between each shaft and the frame.

Preferably also, two or more elongate passages are provided, the pair of shafts of the guide means for each passage being inter-connected whereby on movement of one pair of shafts corresponding movement is made by the other pair(s) of shafts. Each component is preferably a flap tangentially mounted on the respective shaft.

Preferably further, corresponding wall members of the flow channel of the or each passage are hinged along the edge of the inner side of the respective flap. The wall members, near to their outer side, each preferably has a pin engaged in an arcuate slot in an end wall of the frame, the slots for each passage being divergent outwardly. The outer ends of the wall members are beneficially parallel if curved to extend beyond the front of the frame. For each guide means, the side of the hinged wall member is shaped and the inner side of the respective flap is preferably of complementary shape at its channel-defining face.

The frame is desirably of rectangular shape having a surrounding frame for surface-engagement with a reverse surround extension with provision for one or more passages therein.

The surround extension desirably has two end walls, two side walls with an intermediate longitudinal passage-dividing wall for each passage provided. Depending on the length of each-passage in the frame, one or more intermediate transverse support partitions may be provided.

Embodiments of the present invention will now be described, by way of example, with reference to the accompanying drawings, in which:

FIG. 4 is a rear perspective view to a smaller scale of a diffuser frame having two passages according to a fourth embodiment;

FIG. 5 is a partial end view in the direction of arrow "A" on FIG. 3;

FIG. 6 is a side view of an end wall for a passage in a frame according to any one embodiment;

FIG. 7 is a cross-sectional view on an intermediate passage-dividing wall;

Figure 1:
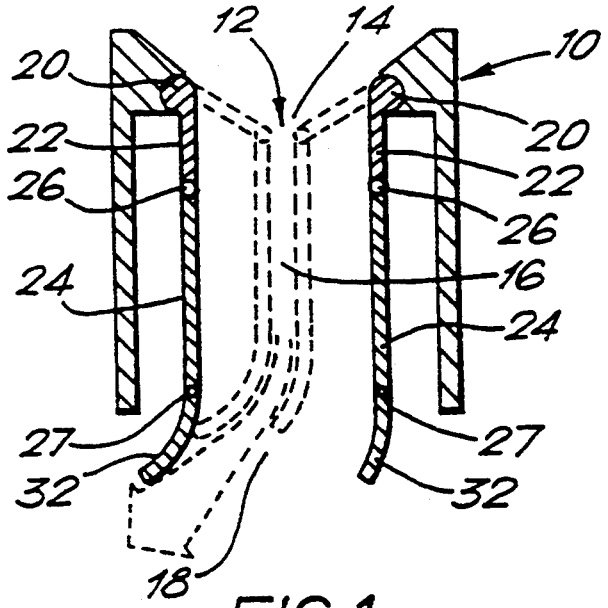
FIG. 1 is a cross-sectional view of an air flow controller according to a first embodiment of the present invention, showing respectively the controller in a fully open position, with a semi-closed position being shown in broken line.

Referring to the drawings, an air flow controller has an adjustable air flow passageway in general comprises a surface-mounted distribution frame 10 housing one or more elongate passages 12. Each passage 12 has an inlet 14, a flow channel 16 and an outlet 18. The inlet 14 has two opposed guide means to control the flow of air passing into the flow channel 16.

The two opposed guide means for the or each passage are two elongate devices, each having a shaft 20. The pair of shafts 20 each mount a similar component having a planar control side, the shafts 20 being counter-rotatable together to vary or close the opening therebetween. Each component is a flap 22 tangentially mounted on the respective shaft 20. A seal is provided between each shaft 20 and the part of the frame 10 against which it is movable.

Two or more elongate passages are provided, the pair of shafts of the guide means for each passage being inter-connected whereby on movement of one pair of shafts corresponding movement is made by the other pair(s) of shafts.

Two opposed wall members 24 define the width of the channel 16, the wall members 24 being adapted to be position-adjusted on control movement of the guide means with the outer ends of the wall members 24 defining the outlet 18.

Figure 8:
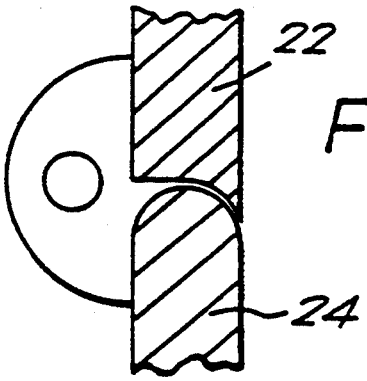
FIG. 8 is a cross-sectional view of a hinged joint between a flap and a wall member of each passage.

Corresponding wall members 24 of the flow channel 16 of the or each passage 12 are hinged at 26 along the edge of the inner side of the respective flap 22. The wall members 24, near to their outer side, each has a pin 27 engaged in an arcuate slot 28 in an end wall 30 of the frame 10. The slots 28 for each passage 12 are divergent outwardly as shown in FIG. 6. The outer ends of the wall members 24 are parallelly curved as shown at 32 to extends beyond the front of the frame 10. For each guide means, the side of the hinged wall member 24 is shaped at its channel defining face as shown in FIG. 8 to receive the inner side of the respective flap 22 which is of complementary shape.

The frame 10 is of rectangular shape having an a surrounding frame 34 for surface-engagement with a reverse surround extension 36 with provision for one or more passages 12 therein. The surround extension 36 has two end walls 30, two side walls 38 with an intermediate longitudinal passage-dividing wall 40 for each passage 10 provided. Depending on the length of each passage 12 in the frame 10, one or more intermediate transverse support partitions 42 is provided. Each side wall 38 is inwardly shaped to converge towards the guide means and has a concave recess to receive the corresponding shaft 20 as shown. Each dividing wall 40 is shaped as two back-to-back end walls 30. Each end wall 30 and each partition 42 having bearing holes to receive bearings through which the respective shafts extends and also the slots 28.

The shafts 20 are extended at one end of the frame 10 and cogs 44 are mounted thereon. The cogs 44 of each pair of shafts 20 mesh together to rotate in a counter-clockwise direction and if two or more pairs of shafts 20 are provided, these are interlinked. One shaft 20 of the first pair of shafts 20 is driven through a coupling from a drive shaft of an electric motor 46 integrated into an electric circuit (not shown) and operable, for example, automatically by a remote temperature sensitive room control switch (not shown), or a manually operable ON/OFF switch (not shown), or a manually operable infrared remote control switch (not shown).

Figure 9:
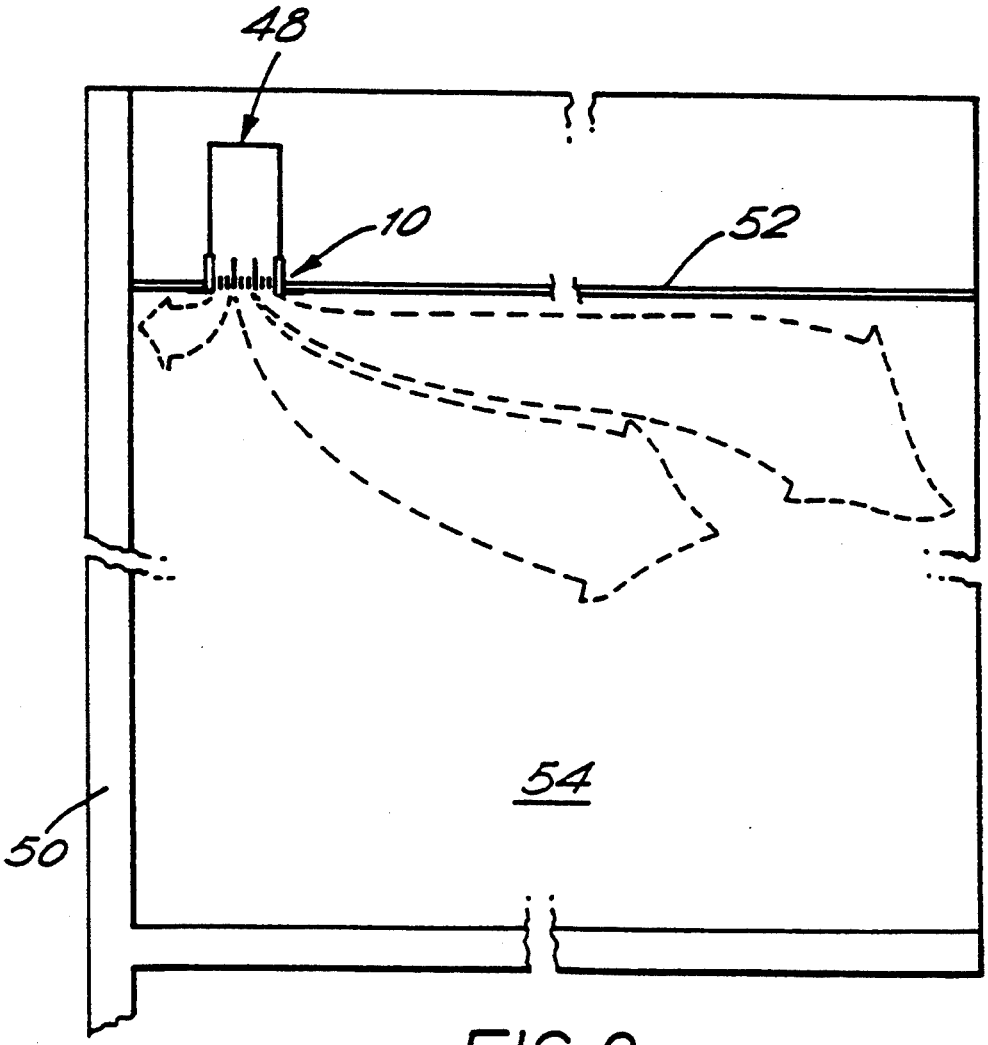
FIG. 9 is a cross-sectional view of a room showing an air flow controller mounted in a ceiling thereof.

In a first embodiment as shown in FIGS. 1, 6, 8 and 9, the air flow controller is as described above, and in use is integrated into a forced air distribution system 48 as shown in FIG. 9, the frame being recessed into prepared openings in a wall 50 or ceiling 52. Air fed from the system under pressure flows into the passage and delivers it into the room 54 in the form of a jet air stream. The width of the passage 12 can be adjusted by operation of the motor 46, the angular adjustment of the flaps 22 towards the vertical reducing or dampening the flow of air passing into the channel 16 and therefore passing out through the outlet 18, and towards the horizontal, increasing the flow of air passing into the channel 16. Movement of the flaps 22 causes corresponding movement of the pins 26 in slots 28 so that the width of the channel 16 at the inlet 14 and at the outlet 18 is constant.

Figure 2:
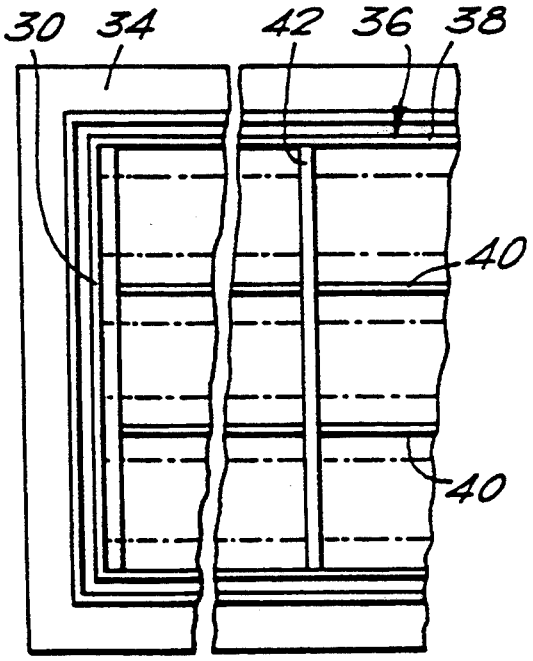
FIG. 2 is a plan view of one end of a diffuser frame having three passages according to a second embodiment.
Figure 3:
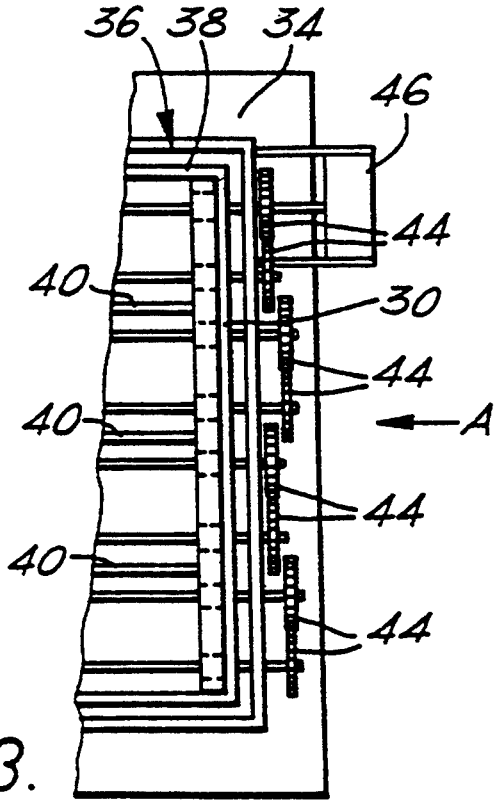
FIG. 3 is a rear plan view of the other end of the diffuser frame having four passages according to a third embodiment.

In the other embodiments shown in FIGS. 2, 3 and 4, and in which like parts are denoted by like numerals, different widths of frames are shown to accommodate two, three and four passages 12 respectively. The passages 12 in each of the different sized frames 10 operate in the same way as the single passage described above, the operation of the motor 46, causing all the cogs 44 to simultaneously operate the flaps 22 of the respective pairs of guide means.

In a first modification, the flaps 22 may be replaced by other shaped components providing a planar control side, for example quadrant shaped components.

In a second modification, frame 10 may be shaped to protrude convexly from the surface, and the outlets 18 may discharge straight ahead rather than be deflected as described above.

Variations and other modifications can be made without departing from the scope of the invention described above and as claimed hereinafter.

I claim:

1. An air flow controller having an adjustable air flow passageway comprising a surface-mounted distribution frame that houses at least one elongate passage, said at least one elongate passage having an inlet (14), a central flow channel (16) and an outlet (18), the inlet having first and second opposed guide means (22) to control the flow channel, said first and second opposed guide means for the air passage comprise first and second elongate devices, each of said first and second elongate devices being secured to a first and a second shaft, each first and second shaft being counter-rotatable together to vary or close the opening between said first and second elongate devices, first and second opposed parallel wall members (24) defining the width of the channel, the first and second opposed wall members being individually pivotably secured to the distal end of the first and second elongate devices to define the outlet whereby control movement of the guide means position-adjusts the wall members.

2. An air flow controller according to claim 1, wherein a seal is provided between said first and second shaft and the frame.

3. An air flow controller according to claim 1, wherein at least two elongate passages are provided with guide means, a pair of first and second shafts are provided for the guide means for each passage, said pair of said first and second shafts of each guide means being inter-connected whereby on movement of one pair of shafts corresponding movement is made by the other pair(s) of shafts.

4. An air flow controller according to claim 2, wherein at least two elongate passages are provided with guide means, a pair of first and second shafts are provided for the guide means for each passage, said pair of said first and second shafts of each guide means being inter-connected whereby on movement of one pair of shafts a corresponding movement is made by the other pair(s) of shafts.

5. An air flow controller according to claim 1, wherein each of said first and second elongate devices is a flap tangentially mounted on their respective shaft.

6. An air flow controller according to claim 5, wherein corresponding wall members of the flow channel of each of said first and second elongate devices include a hinge.

7. An air flow controller according to claim 1, wherein each of said first and second wall members (24) include a pin (27) near to their outer end, each pin engages an arcuate slot (28) in an end wall (30) of the frame, and the arcuate slots in each end wall diverge outwardly.

8. An air flow controller according to claim 7, wherein the outer ends of the first and second wall members are curved to extend beyond a front of the frame.

9. An air flow controller according to claim 6, wherein for each said first and second guide means, a surface of the hanged wall members has a complementary shape with an inner surface of a respective flap along a channel defining face whereby the air-flow surfaces of the first and second elongated devices and the wall members are coordinated to provide a substantially smooth passage therethrough.

10. An air flow controller according to claim 7, wherein for each said first and second guide means, a surface of the hinged wall members has a complementary shape with an inner surface of a respective flap along a channel defining face whereby the air-flow surfaces of the first and second elongate devices and the wall members are coordinated to provide a substantially smooth passage therethrough

11. An air flow controller according to claim 8, wherein for each said first and second guide means, a surface of the hinged wall members has a complementary shape with an inner surface of a respective flap along a channel defining face whereby the air-flow surface of the first and second elongate devices and the wall members are coordinated to provide a substantially smooth passage therethrough.

12. An air flow controller according to claim 1, wherein the surface mounted distribution frame is of rectangular shape having an upstanding surrounding wall (36) for surface-engagement with a surrounding flat wall extension (34) in which the surface mounted distribution frame has a provision for one or more passages therein.

13. An air flow controller according to claim 12, wherein the upstanding surrounding wall (36) has two opposed parallel end walls (30), two opposed parallel side walls (38) with an intermediate longitudinal passage-dividing wall (40) which is parallel with said opposed parallel side walls.

14. An air flow controller according to claim 13, wherein depending on the length of each passage in the frame, one or more intermediate transverse support partitions may be provided.

15. An air flow controller having an adjustable air flow passageway comprising a surface-mounted distribution frame that houses at least one elongate passage, said at least one elongate passage having an inlet (14), a central flow channel 16) and an outlet (18), the inlet having first and second opposed guide means (22) to control the flow channel, said first and second opposed guide means for the air passage comprise first and second complementary elongate devices, each of said first and second elongate devices being secured to a first and a second shaft, each first and second shaft being simultaneously counter-rotatable together to vary or close the opening between said first and second elongate devices, first and second complementary opposed parallel wall members (24) defining whereby width of the channel, the first and second opposed wall members are individually pivotably secured to the distal end of the first and second elongate devices to control movement of the guide means whereby said first and second guide means and said first and second opposed wall members define a substantially smooth passage to the outlet.

* * * * *

UNITED STATES PATENT AND TRADEMARK OFFICE

CERTIFICATE OF CORRECTION

PATENT NO. : 5,447,471

DATED : September 5, 1995

INVENTOR(S) : Robert J. McDermott

It is certified that error appears in the above-identified patent and that said Letters Patent is hereby corrected as shown below:

Col. 6, line 10, change "whereby" to --the--.

Signed and Sealed this

Thirtieth Day of April, 1996

Bruce Lehman

*Attest:*

BRUCE LEHMAN

*Attesting Officer*

*Commissioner of Patents and Trademarks*